United States Patent [19]

Stewart

[11] Patent Number: 4,973,059

[45] Date of Patent: Nov. 27, 1990

[54] VOLLEYBALL NET ADJUSTER

[76] Inventor: John V. Stewart, 1308 Henry Balch Dr., Orlando, Fla. 32810

[21] Appl. No.: 477,163

[22] Filed: Feb. 8, 1990

Related U.S. Application Data

[63] Continuation-in-part of Ser. No. 377,810, Jul. 10, 1989, abandoned, which is a continuation-in-part of Ser. No. 291,663, Dec. 29, 1988, abandoned.

[51] Int. Cl.[5] ..... A63B 61/04; A63B 71/02

[52] U.S. Cl. ..... 273/411; 273/29 BC

[58] Field of Search ..... 273/411, 29 BB, 29 BC, 273/29 BD

[56] References Cited

U.S. PATENT DOCUMENTS

| | | | |
|---|---|---|---|
| 2,638,346 | 5/1953 | Stapleton | 273/29 BB |
| 3,940,139 | 2/1976 | Barnes | 273/411 |
| 4,153,247 | 5/1979 | Burns | 273/29 BC |

OTHER PUBLICATIONS

Jayfro Catalog, p. 10, No Publication Date.
Senoh Catalog, 1 page, No. Page Number, No Publication Date.
Schelde Catalog, pp. 3–4, No Publication Date.

*Primary Examiner*—William H. Grieb

[57] ABSTRACT

An apparatus for quick convenient adjustment of the tension and height of volleyball nets comprises a vertically slidable hardware mounting platform on each net post, containing cable-connection hardware, including winch means. Net height is changed by sliding the mount, without the need to disconnect cables. Through an arrangement of pulleys, a single winch tightens both the upper and lower net cables in unison, with equal force. The pulleys double the winch pull, allowing use of a light winch. They can also be configured to provide single pull on the lower cable, for nets with a steel upper cable and a rope lower cable. Two versions of the slidable mount are described; one is a sleeve on the net post, and the other is a track and slide, in which the track is connected to the post, guiding and retaining the slide.

21 Claims, 5 Drawing Sheets

Figure 10:
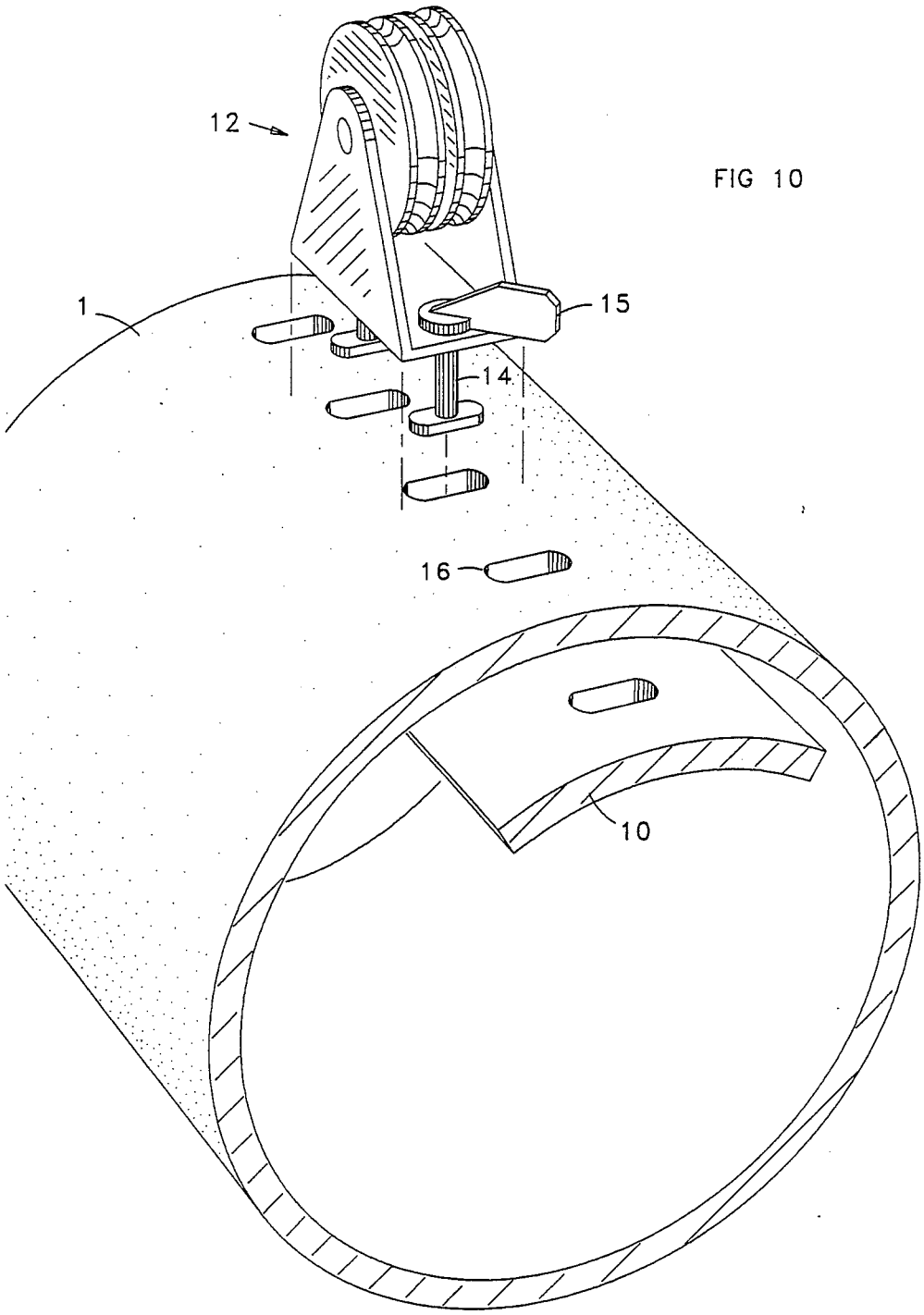

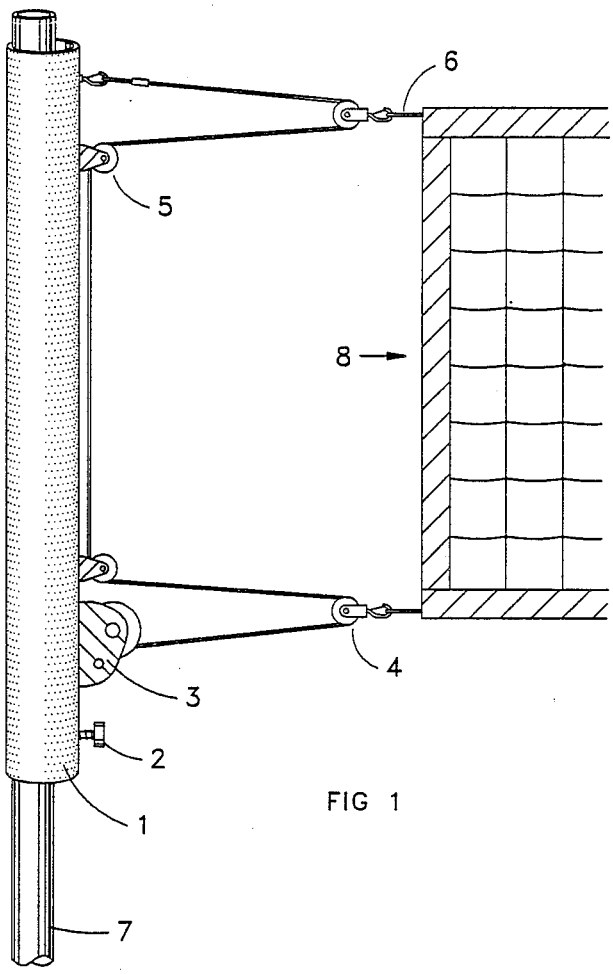
FIG 1
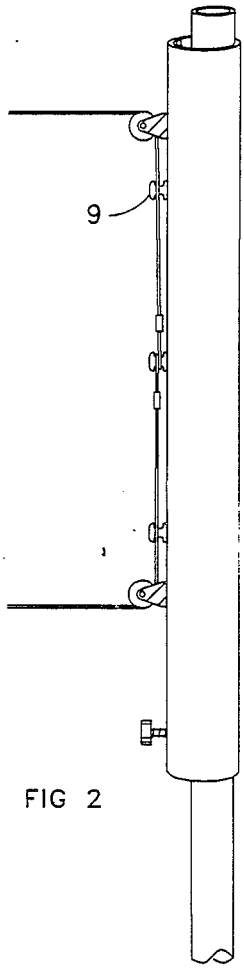
FIG 2
FIG 3
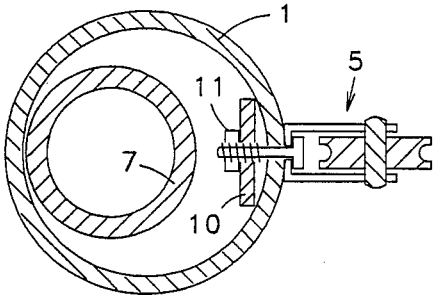
FIG 4
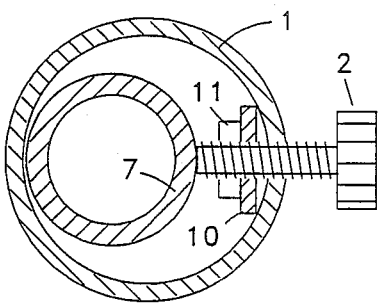

FIG 5
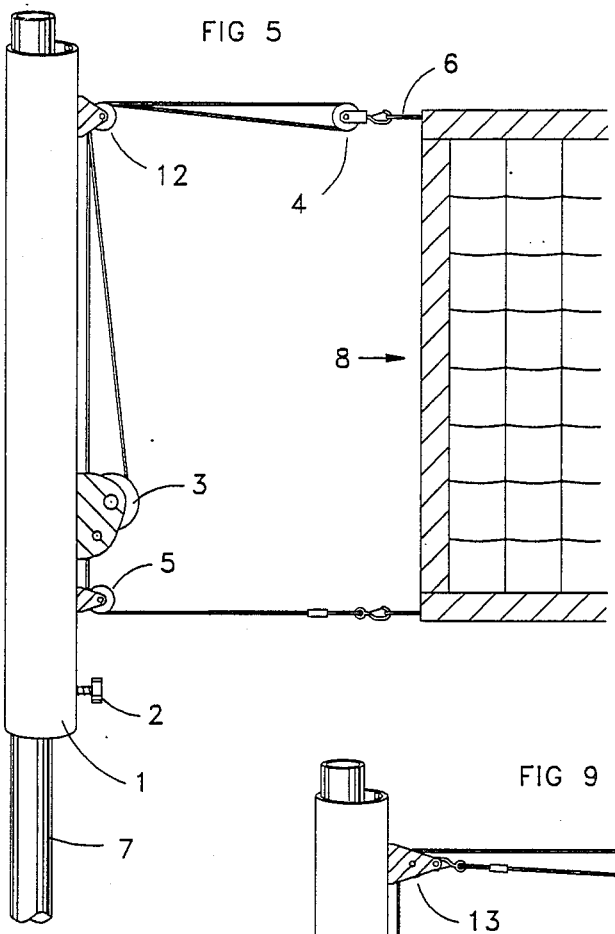
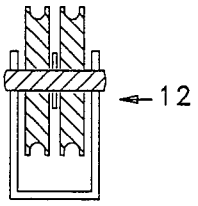
FIG 6
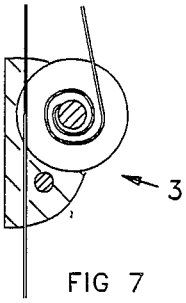
FIG 7
FIG 9
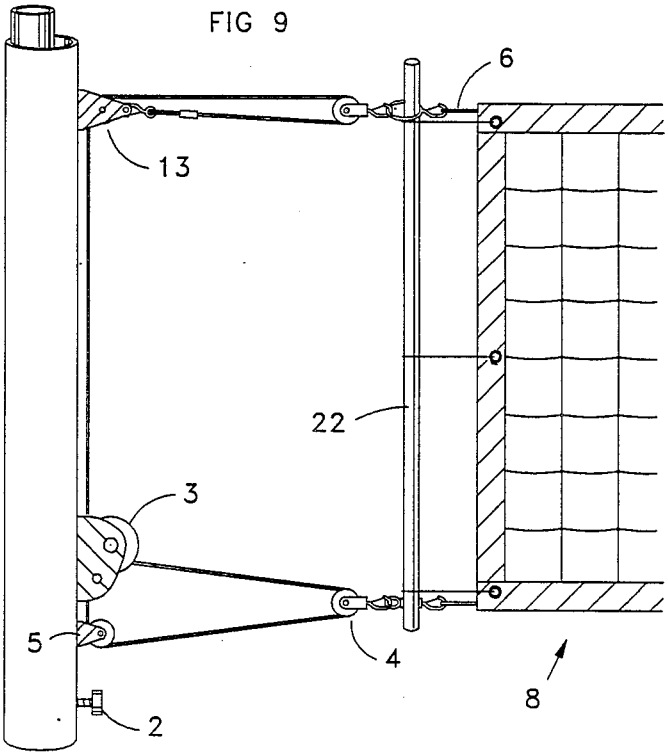
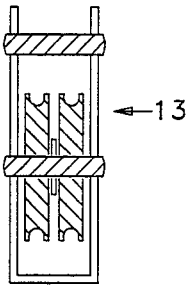
FIG 8

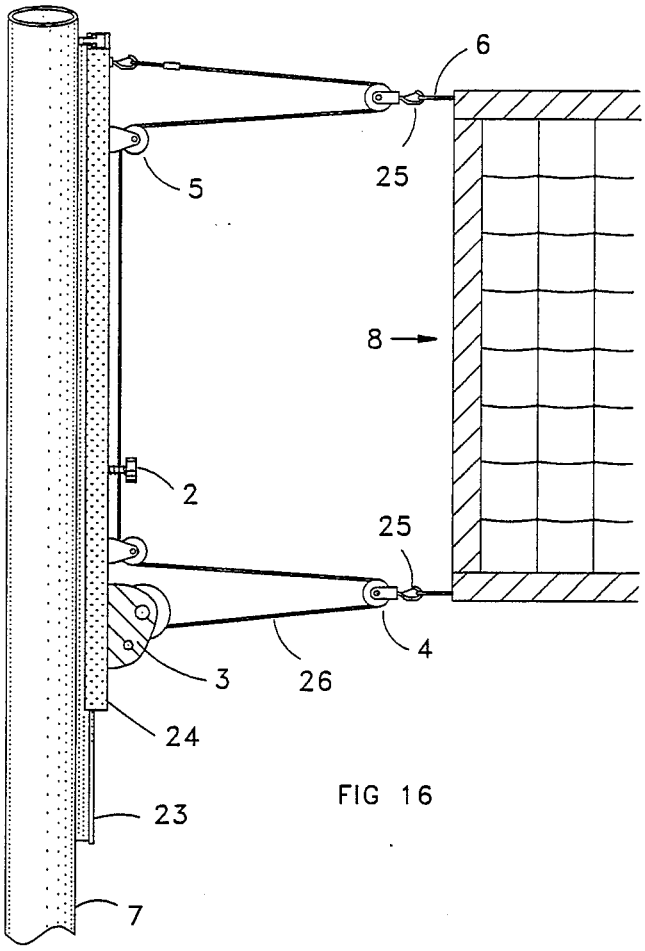
FIG 16
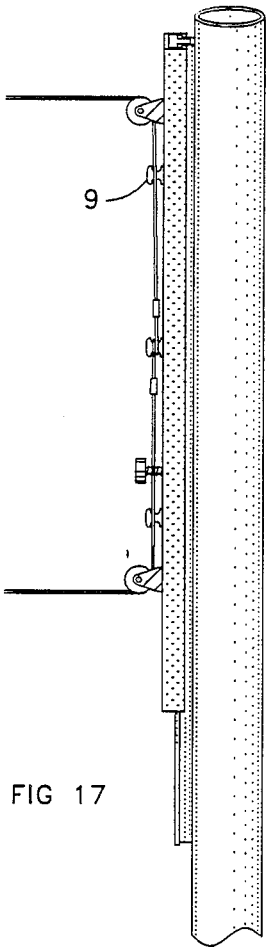
FIG 17
FIG 18
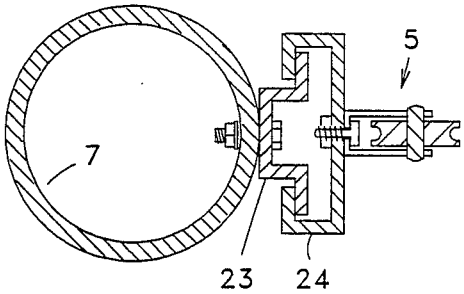
FIG 19
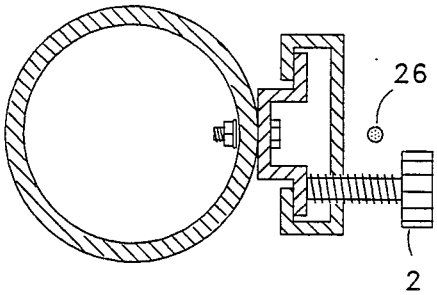

VOLLEYBALL NET ADJUSTER

This is a continuation-in-part of application Ser. No. 07/377,810, filed 7/10/89 now abandoned, which was a continuation-in-part of application Ser. No. 07/291/663, filed 12/29/88 now abandoned.

BACKGROUND

1. Field of Invention

This invention relates to equipment for adjustment of the height and tension of volleyball nets.

2. Background - Prior Art

Volleyball is becoming more popular in the U.S., with an increase in professional tournaments and prize money, including men's and women's beach doubles tournaments offering millions of dollars yearly. Court set-up is exacting for volleyball tournaments of all types, indoors and out, and for all courts where advanced players play and practice. The height and tension of the net is prescribed in the rules of play, and height is different for women and men. Therefore, net poles must provide means to adjust the net height and tension. Establishing and maintaining net height on sand courts is made more difficult by the uneven and changing level of the playing surface.

Many net posts are only adjustable in discrete steps, by selecting among fixed connectors on the posts. These types are very tedious and time consuming to adjust properly. Some have a winch for the upper net cord, making its tensioning easier, and some have a winch for the bottom cord as well. However, net height adjustments using these combinations are iterative because reconnecting and tensioning of each main cable and net-edge cord changes both the height of the net and the tension required of the other cables and cords. Thus, court set-up and gender change is difficult or inconvenient, due the limitations of net adjustment mechanisms.

Often, permanent posts in sand courts are not tall enough to provide proper net height. This can happen when court sand has been replenished, or through the shifting of sand toward the net by play wear. Net attachment points may have originally been at proper height, but later no adjustment can be made without court or post repair.

An expensive mechanism for indoor courts partially solves the adjustment problem by utilizing a telescoping net post, comprising a movable upper post inserted into a fixed bottom tube. Once net cord tension is adjusted, it need not be readjusted to change the net height. The whole upper portion of the post moves by turning a crank. This works reasonably well, but both sides of the net must be adjusted in unison, or the net is over-tensioned when one side is moved, thus two people are required. With only one person, the net must be adjusted the old-fashioned way, except that the cords need only be loosened, not reattached, since the attachment points themselves move. This mechanism is impractical for most installations, due to its expense. The telescoping portion has bearing runners guided by greased tracks in the fixed tube, and has a long rack of gears for the cranking pinion. Both the fixed and telescoping sections must be very strong to resist the lateral leverage of net tension and play stress, so the device is too heavy for mobile use. The greased bearing surfaces are not appropriate for sand courts.

OBJECTS AND ADVANTAGES

The object is a volleyball net adjustment mechanism that is quick and convenient, provides infinite height variation within a wide range, is inexpensive and light weight, making it practical for both temporary and permanent installations, indoors or out, can be easily installed on existing posts, and can extend the connection height on a post which is too short.

The present invention achieves these objectives. Convenience is achieved by providing means to tension both net cables in unison from one winch. This saves expense and weight versus a dual-winch apparatus, and adjustment time is reduced by half. The net connectors move in unison vertically with a sleeve or other slidable mount on which they are mounted. This eliminates reconnection of cables. The sleeve can be a light and inexpensive material, such as PVC pipe, due to the the absence of leverage on the sleeve, and to a described means for distributing anchoring stress. Pulleys double the force of the winch, allowing use of a light, inexpensive winch. The tension of the top and bottom net cords is automatically equalized. As an option, the bottom cord can have half the tension of the top cord. The sleeve can be installed on existing posts, and can extend above a post that is too short.

Drawing figures:

FIG. 1 - Configuration, with equal upper and lower tension

FIG. 2 - Opposite post, with studs for quick attachment of cords

FIG. 3 - Anchoring of fixed pulley to sleeve, section

FIG. 4 - Sleeve fixing bolt, section

FIG. 5 - Embodiment providing half as much tension on the bottom as the top

FIG. 6 - Detail of dual pulley 12 used in FIG. 5

FIG. 7 - Detail of winch, showing cable pass-through

FIG. 8 - Detail of dual pulley 13 with hook bar used in FIG. 8

FIG. 9 - Flexible embodiment, configurable for equal tension as shown, or unequal tension, as in FIG. 5

Figure 11:
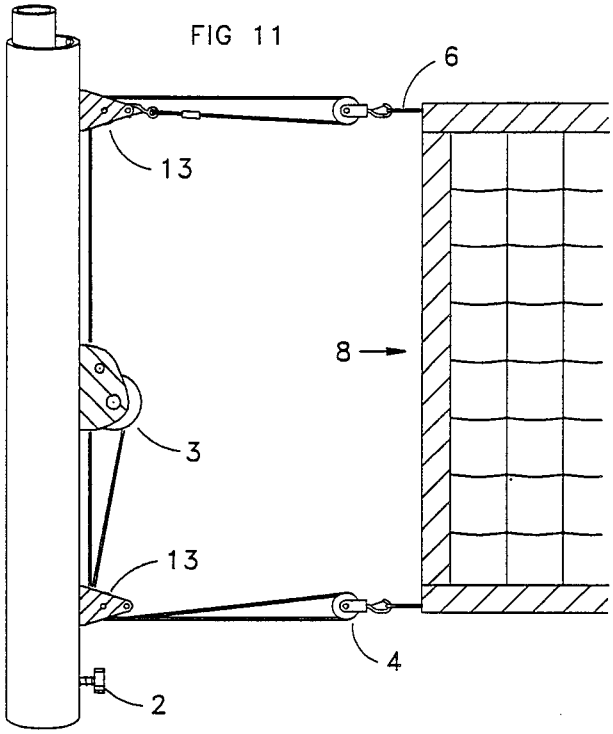
Figure 12:
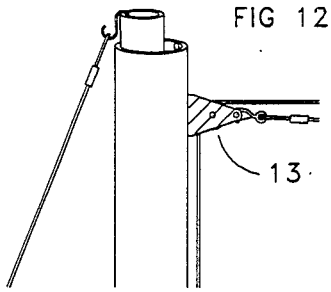
Figure 13:
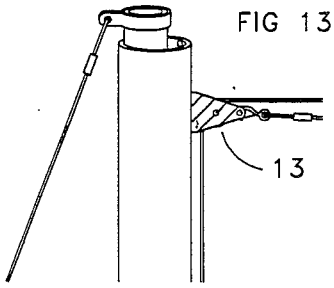
Figure 14:
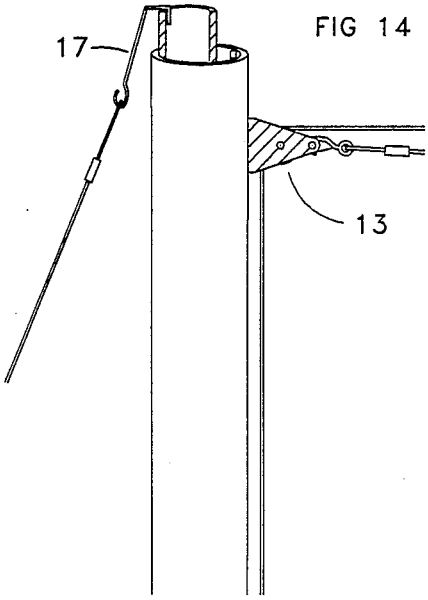
Figure 15:
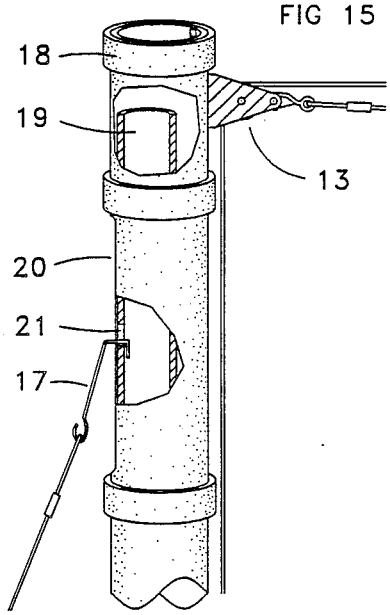

FIG. 10 - Repositioning means for hardware, showing quick-connect bolts and apertures FIG. 11 - Flexible embodiment having dual fixed pulleys with hook bars on both top and bottom of sleeve FIG. 12 - Guy wire attachment using S-hook FIG. 13 - Guy wire attachment using hoop clamp FIG. 14 - Guy wire attachment using special standoff hook FIG. 15 - Guy wire attachment at mid sleeve through vertically aligned aperture, showing reinforcement bands FIG. 16 - Track-and-slide embodiment FIG. 17 - Opposing post for FIG. 16

FIG. 18 - Horizontal section through post, track, slide, and a pulley

FIG. 19 - Section view showing fixing bolt

Drawing reference numerals:

Sleeve
Fixing bolt
Winch means
Movable pulley
Fixed pulley
Net cable
Net post
Volleyball net
Stud or cleat stud
Anchor bar Nut
Fixed dual pulley
Fixed dual pulley with hook bar
Quick-connect anchor bolt
Optional thumb lever
Aperture series for alternate positioning of hardware
Guy-wire hook
Reinforcement band
Top of post
Vertically aligned slot in sleeve back
Hole in post for guy-wire hook
Tie-down for cords from net edge tape
Track
Slide
Cable connector
Winch cable

DESCRIPTION:

FIG. 1 shows a basic embodiment for tournament-grade nets, which have steel cables in the top and bottom. The pulley arrangement tightens both cables in unison from a single winch 3. The pulleys double the force of the winch, allowing use of a lighter winch. This arrangement uses only ¼ of the winch power of current dual-winch arrangements, and is easier to use.

Sleeve 1 slides over net post 7, providing vertical adjustment without reattachment of cables and cords. The sleeve is fixed to the post by fixing bolt 2, which can be hand tightened. It holds the sleeve at a desired vertical position until cable tension is applied, when friction prevents slippage of the sleeve. The fixing bolt does not require holes or depressions in the net post, so the sleeve can be infinitely adjusted within its range. Since no adaptation of the net post is required, the sleeve can be easily installed on existing posts.

An enhancement to the fixing bolt is a saddle piece, with its saddle curved to approximate a nominal post diameter, having a cylindrical depression in its back to receive the end of the fixing bolt. This can be mounted on the end of the bolt to protect the post from wear, and prevent lateral slippage of the end of the bolt when the post diameter is small relative to the sleeve.

Volleyball net posts range in diameter from about 2 to 4.5 inches. Sometimes 4×4 inch timber is used. A sleeve made large enough for a 4.5-inch diameter post, and with a fixing bolt long enough to contact a 2-inch post, will fit all posts, albeit loosly on some. It is preferable to offer sleeves in at least two sizes. The large majority of posts are 3.5 inch in diameter or less. Loosness of the sleeve is not a substantial disadvantage, but its diameter should be minimized for best visibility of the game by players, umpires, and spectators. Clearance between the net post and the interior of the sleeve must allow for anchor bar 10 (FIG. 3) and inwardly protruding nuts.

An anchor bar 10, shown in section in FIG. 3, may be used. It runs the length of the sleeve for the purpose of distributing stress from the hardware attached to the sleeve. This bar allows use of a light, inexpensive sleeve material, such as PVC pipe, rather than metal pipe. If the anchor bar is flat, as shown, the gap between it and the wall of the sleeve should be filled with an incompressable cement filler to evenly distribute stress from the bar to the sleeve wall. The bar can have a curved shape matching the inner wall of the sleeve, to save space and allow the use of a smaller diameter sleeve. A curved bar is shown in FIG. 10. The bar should be of a rigid material, such as steel. It can have threaded apertures to receive hardware attachment bolts, or nuts can be used as in FIG. 3 and 4, or quick-connect bolts can be used as in FIG. 10.

FIG. 2 is a sleeve for the opposite end of the net from FIG. 1. It has cable connections which allow compensation for different cable lengths and post separations. The two cables are shown connected to the central of three studs, knobs, or cleats 9. Attachment points are selected for optimum free cable length toward the winch end of the net. If excess cable reaches beyond the farthest stud, the cable is turned around that stud, brought back, and connected to another stud. Pulleys are unnecessary on this sleeve—an eye bolt will do the job. However, pulleys are suggested as shown to protect the cables from wear.

FIG. 5 is an embodiment for nets having a steel top cable and a rope bottom cable. It provides twice as much tension in the top cable as in the bottom. The winch cable passes through fixed dual pulley 12, then through movable pulley 4, then through the second wheel of pulley 12, then passes through the winch (as in FIG. 7) to single pulley 5, on its way to the net bottom cable. Since the net top cable has a movable pulley, its tension is twice that of the bottom cable, which has none. FIG. 6 is a section view of double pulley 12.

The first and second embodiments (FIGS. 1 and 5) are not interchangeable without reconfiguration of the hardware. FIG. 9 shows a design which can be used either for equal or unequal net cable tension by simply rerouting the winch cable. This is done via a hooking bar on the dual pulley, as shown in FIG. 8, allowing attachment of the end of the winch cable as shown. In the routing shown, using two movable pulleys, the apparatus operates as in FIG. 1. However, the cable can be easily routed as in FIG. 5 by removing or idling the lower movable pulley.

Means should be provided to change the positions of the hardware on the sleeve to compensate for different net widths. Two common net widths are 1 meter and 1 yard, but somewhat smaller and larger widths should be accomodated as well. A quick connection scheme for the hardware is shown in FIG. 10. Only the lower hardware should be provided with alternate positioning means, since it is not needed at both top and bottom. The upper hardware should remain in a fixed position on the sleeve, so net heights can be marked on the post at the bottom of the sleeve. This way, net height need not be measured each time a change is made.

FIG. 10 shows quick connection means for the pulleys, winch, and studs on the sleeve. This allows reconfiguration of the hardware for different nets. Anchor bolts 14 lock behind the anchor bar 10 with a 90 degree twist. These quick-connect bolts are optional, since a change of net types used with a given set of sleeves is not expected to occur frequently. Alternate bolt holes should be provided for the bottom hardware, including the winch, lower pulleys, and lower stud. The bolt holes should be round if normal threaded bolts are used. It is advisable to use two bolts per hardware item, for stability and stress distribution.

Guy wires are sometimes used on volleyball net posts. These can be accompdated either above the sleeve (if the post is tall enough), or at mid-sleeve through a vertically aligned slot in the back of the sleeve, to allow vertical sleeve movement. Some attachment options are shown in FIGS. 12–14. FIGS. 12 and 13 show guy wires attached using standard hardware—a hoop clamp, and an S-hook, respectively. A better guy-wire hook shape is shown in FIG. 13. This can be hooked over the upper lip of the post, and stands-out far enough away from the post to allow full upward movement of the sleeve. This hook can also be used at sleeve midpoint, through the above-mentioned slot, if a hole is drilled in the post to receive it. The hole should be slightly larger than the diamter of the hook rod, and vertically elongated to allow room for insertion of the hook.

To insure longevity of wear when using a light sleeve material, reinforcement bands are suggested at fatigue points. Steel bands can be mounted around the upper and lower end of a sleeve. If PVC is used, a band of it can be cut from PVC coupling and cemented on the sleeve. Similar reinforcement is suggested at both ends of any guy-wire aperture in the sleeve, as in FIG. 15. Extremes of stress should be expected, since players sometimes hit the net or pull on it, and may grab the post for support.

Three attachment points for cords from the net edge are required at both ends of the net. The hook on movable pulleys or the winch cable end, can serve dual purpose for connection of both a main cable and the associated net edge cord. The main cables must be tensioned before the edge cord is attached (this is the normal order of connection). The middle connector can be an eye, hook, or loop on the sleeve beside or over the vertical segment of the winch cable. Another means is shown in FIG. 9, in which a vertical tie-down bar is provided next to the net, connected at the ends of the main cables. This has the advantage of loosening all cords and cables when adjusting wet height. As shown, the tie-down bar has a fixed connector at its lower end, but slides within a ring connector at its top end. This compensates for different net widths automatically.

It is suggested that a diagram of each winch cable configuration, with brief description, be attached to the sleeve next to the winch. The distance from the top of the net to the bottom of the sleeve should be shown for each cable configuration.

The sleeve of FIGS. 1–15 is one possible embodiment of a vertically slidable mounting platform for cable-restraint hardware such as hooks, cleats, a winch, and pulleys. The generic term for this element in the claims is "slidable mount". Another mount embodiment, shown in FIGS. 16–19, is a track and slide. This is less obtrusive from a referees viewpoint, does not limit the maximum post diameter, and does not interfere with guy wires. Track (23) is connected to the post with bolts, as shown in FIG. 18. Connection is easier if the bolts pass completely through to the other side of the post, for access to the bolt end. Slide 24 is guided and restrained by the track. It is made of "C" channel material, preferably aluminum. Steel can also be used, and should be galvanized for outdoor use.

Most elements shown with the sleeve can also be used with the track-and-slide. These include the various pulley and winch configurations, hardware repositioning means, and tie-down bar 22. Anchor bar 10 is useful in the slide, especially if the slide is aluminum rather than steel. Sections of anchor bar may be applied wherever hardware is attached, rather than the full length of the slide, saving weight. Reinforcement bands, if used, follow the channel shape of the slide, including the gap for the track. Since adaptation of these elements is straightforward as described, their drawings are not duplicated for the track-and-slide embodiment. The special guy wire arrangements of FIGS. 12-14 15, are unnecessary with the track and slide, although they may be used.

The winch-and-pulley arrangement may be used without a slidable mount. This is useful for tension adjustment of sport nets where height changes are not needed, such as badminton nets. It can also be used by volleyball installations unconcerned with accurate height, but wanting quick set-ups, or where height changes are infrequent and hardware repositioning by other means is satisfactory.

Preferred Embodiment:

The preferred embodiment of the slidable mount is the track-and-slide type, since it attaches to posts of any size, and does not interfere with guy wires. The preferred material is aluminum, reinforced at hardware attachments with an anchor bar. Steel can also be used, and should be galvanized for outdoor use.

Each of the pulley configurations of FIGS. 1, 5, 9, and 11, has its advantages. The FIG. 1 configuration is simplest, and provides equal tension in the upper and lower net cables. This is optimum for nets with equal cables in the top and bottom. FIG. 5 is the simplest embodiment with unequal tension, however, with only a small enhancement and an extra available pulley, as shown in FIG. 9, the tension proportion becomes selectable. From FIG. 9 to FIG. 11, the single pulley 5 is replaced with a dual pulley 13 with hook bar, for even more flexibility. If only one embodiment were to be available, the choice would be FIG. 9, since it is the simpler of the two flexible configurations.

Some type of alternate positioning means, such as in FIG. 10, should be offered for the winch and lower pulley, allowing a range of net widths, including 1 yard and 1 meter. Quick-connect bolts should generally have screwdriver slots in their heads instead of the optional thumb levers shown.

In the sleeve embodiment, the preferred sleeve material is PVC pipe, since it is light and inexpensive. A curved steel anchor bar as in FIG. 10 is suggested. The sleeve should be reinforced with a PVC band at both ends. A guy-wire hook for use as in FIG. 14 should be provided.

Operation:

To change net height, winch tension is released to remove friction in the slidable mount, which is then repositioned by temporarily releasing its fixing bolt, and the winch is re-tightened.

The net posts should be marked for men's and women's height at the bottom of each sleeve. The instructions with the sleeves should state the distance from the top of the net to the bottom of the sleeve for each cable configuration. Thus net height can be established initially, by measuring from the floor to the bottom of the sleeve, and subsequent adjustments can use the marks.

Claim terminology:

In the claims, the term "equidistant" is intended to include coincident. Thus, when two components are described as mounted approximately equidistant from a given position, this includes the case where they are mounted coincident with each other. This minor clarification is significant because the pulley configurations of both FIG. 1 and FIG. 9 are thereby both covered under claim 29. In FIG. 9, the cable end anchoring means is shown as part of fixed pulley 13, making the two elements coincident, whereas in FIG. 1 the two elements are separated.

The term "elongated hollow sleeve" is not limited to cylindrical shapes. It may be any tubular shape, including prismatic.

In "first and second attachments for volleyball net cables", the order is arbitrary. That is, the first attachment can be either the top or bottom one, and the second attachment is the remaining one. This allows a claim to cover configurations in which the winch cable is routed to the top attachment first, as well as configurations in which the winch cable is routed to the bottom attachment first.

"Winch means" includes any cable tensioning means, such as a windlass or ratchet device.

The term "sport net post" means a standard for sport nets such volleyball, badminton, or tennis nets, which are suspended horizontally between two such posts.

I claim:

1. A sport net tension adjuster comprising:
a sport net post;
a winch cable;
winch means for adjustably tensioning said winch cable;
said winch cable attached to said winch means;
said winch means attached to said post;
first and second connectors for attachment of cable; and
pulley means for routing said winch cable from said winch means to said first connector, thence to said post, thence to said second connector.

2. A volleyball net tension and height adjuster comprising:
a vertically slidable mount on a volleyball net post;
means for releasably fixing said mount at an adjustable position; a winch cable;
winch means for adjustably tensioning said winch cable;
said winch cable attached to said winch means;
said winch means attached to said mount;
first and second connectors for attachment of cable; and
pulley means for routing said winch cable from said winch means to said first connector, thence to said mount, thence to said second connector.

3. The adjuster of claim 1, wherein said slidable mount comprises a track affixed to said post, and a slide guided on said track.

4. The adjuster of claim 1, wherein said slidable mount comprises an elongated hollow sleeve slidably mounted on said post.

5. The net adjuster of claim 4, further including an anchor bar adjacent the interior wall of said sleeve, comprising an elongated rigid bar with apertures for anchor bolts.

6. The net adjuster of claim 5, further including an incompressable filler between said anchor bar and the adjacent interior wall of said sleeve, for even distribution of stress from said anchor bar to the wall of said sleeve.

7. The net adjuster of claim 1, further including alternate positioning means for repositioning of hardware attached to said mount, comprising anchor bolts and a series of anchor apertures through said mount for selective location of said anchor bolts.

8. The alternate positioning means of claim 7 wherein said anchor bolts have T-shaped ends, and said anchor apertures are elongated to act as keyholes for said anchor bolts, whereby said anchor bolts can be inserted in said apertures and twisted to lock said anchor bolts in said apertures.

9. The net adjuster of claim 1, further including a tie-down bar for cords from the net edge, comprising a rigid bar mounted vertically at each end of the net between approximately the connection points at the ends of the net main cables.

10. The adjuster of claim 1 wherein said pulley means comprises:
a first fixed pulley;
said winch means and said first fixed pulley being attached to said mount approximately equidistant from a position corresponding to the lower edge of a volleyball net;
a second fixed pulley;
cable end anchoring means for anchoring the end of said winch cable to said mount;
said second fixed pulley and said cable end anchoring means being attached to said mount approximately equidistant from a position corresponding to the upper edge of a volleyball net; and
first and second movable pulleys mountable on said winch cable.

11. The adjuster of claim 10 wherein said winch cable is routed from said winch means to said first movable pulley, thence to said first fixed pulley, thence to said second fixed pulley, thence to said second movable pulley, thence to said cable end anchoring means, said first connector is attached to said first movable pulley, and said second connector is attached to said second movable pulley, whereby the bottom and top cables of a volleyball net can be connected to said first and second movable pulleys respectively, allowing both net cables to be tensioned in unison by said winch means.

12. The adjuster of claim 1 wherein said pulley means comprises:
a first fixed pulley, attached to said mount at a position corresponding to the lower edge of a volleyball net;
second and third fixed pulleys, attached to said mount approximately equidistant from a position corresponding to the upper edge of a volleyball net; and
a first movable pulley, mountable on said winch cable.

13. The net adjuster of claim 12 wherein said winch cable is routed from said winch means to said second fixed pulley, thence to said first movable pulley, thence to said third fixed pulley, thence around said first fixed pulley, said first connector is attached to said first movable pulley, and said second connector is attached to said winch cable, whereby the bottom and top cables of a volleyball net can be connected to the end of said winch cable and to said first movable pulley respectively, allowing both net cables to be tensioned in unison by said winch means.

14. The net adjuster of claim 11, further including cable end anchoring means for anchoring the end of said winch cable to said mount, said cable end anchoring means and said second fixed pulley being attached to said mount approximately equidistant from a position corresponding to the top edge of a volleyball net, and a second movable pulley, mountable on said winch cable.

15. The net adjuster of claim 14 wherein said winch cable is routed from said winch means to said second movable pulley, thence to said first fixed pulley, thence to said second fixed pulley, thence to said first movable pulley, thence to said cable end anchoring means, said first connector is attached to said second movable pulley, and said second connector is attached to said first movable pulley, whereby the top and bottom cables of a volleyball net can be connected to said first and second movable pulleys respectively, allowing both net cables to be tensioned in unison by said winch means.

16. The net adjuster of claim 2 wherein said pulley means comprises:

first, second, third, and fourth fixed pulleys;

first and second cable end anchoring means;

said first and second fixed pulleys and said first cable end anchoring means being attached to said mount at a position corresponding to the lower edge of a volleyball net;

said third and fourth fixed pulleys and said second cable end anchoring means being attached to said mount at a position corresponding to the upper edge of a volleyball net; and a movable pulley mountable on said winch cable.

17. An improved volleyball net standard system, in which the improvement comprises:

a first vertically slidable mount on a first volleyball net post;

means for releasably fixing said first mount at an adjustable position;

a winch cable;

winch means for adjustable tensioning of said winch cable;

said winch cable attached to said winch means;

said winch means attached to said mount;

first and second connectors for attachment of cable; and pulley means for routing said winch cable from said winch means to said first connector, thence to said mount, thence to said second connector.

18. The improvement of claim 17, wherein said slidable mount comprises a track affixed to said post, and a slide guided on said track.

19. The improvement of claim 17, wherein said slidable mount comprises an elongated hollow sleeve slidably mounted on said post.

20. The improvement of claim 17, further including:

a second vertically slidable mount on a second volleyball net post; means for releasably fixing said second mount at an adjustable position; and attachment means for attaching top and bottom volleyball net cables to said second mount.

21. The improvement of claim 20 wherein said attachment means comprises upper and lower redirection means for redirecting upper and lower net cables approximately 90 degrees toward the center of said second slidable mount, and a plurality of cleat means for connecting cable ends, connected to said second slidable mount between said two redirection means.

* * * * *

UNITED STATES PATENT AND TRADEMARK OFFICE

CERTIFICATE OF CORRECTION

PATENT NO. : 4,973,059

DATED : Nov. 27, 1990

INVENTOR(S) : John Vernon Stewart

It is certified that error appears in the above-identified patent and that said Letters Patent is hereby corrected as shown below:

In claims 3, 4, 7, 9, and 10, change "claim 1" to --claim 2--.

In claim 14, change "claim 11" to --claim 12--.

Col. 2 at bottom, and col. 3 at top, add reference numerals to the list of elements, sequentially from 1 to 26: --1 Sleeve ... 26 Winch cable--.

Col. 6, line 63, change "claim 29" to --claim 10--.

Col. 5, line 67, change "FIGS. 12-14 15" to --FIGS. 12-15--.

Col. 2, line 67, change "Stud or cleat stud" to --Stud or cleat--.

Col. 7, line 31, place "a winch cable;" on a new line, indented.

Signed and Sealed this

Seventh Day of January, 1992

*Attest:*

HARRY F. MANBECK, JR.

*Attesting Officer*

*Commissioner of Patents and Trademarks*